US006699066B2

(12) United States Patent
Wu

(10) Patent No.: US 6,699,066 B2
(45) Date of Patent: Mar. 2, 2004

(54) ELECTRICAL CONNECTOR ASSEMBLY

(75) Inventor: Min-Fang Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/266,490

(22) Filed: Oct. 7, 2002

(65) Prior Publication Data

US 2003/0236025 A1 Dec. 25, 2003

(30) Foreign Application Priority Data

Jun. 20, 2002 (TW) ..... 91209266 U

(51) Int. Cl.[7] ..... H01R 12/24
(52) U.S. Cl. ..... 439/495; 439/357
(58) Field of Search ..... 439/495, 327, 439/329, 496, 497, 79, 80, 67, 77, 357

(56) References Cited

U.S. PATENT DOCUMENTS 5,397,247 A * 3/1995 Aoki et al. ..... 439/496
5,580,272 A 12/1996 Yamaguchi et al.
5,695,360 A 12/1997 Seto et al.
5,947,764 A 9/1999 Pan et al.
5,967,831 A 10/1999 Yamada et al.
6,159,038 A * 12/2000 Wu ..... 439/495
6,280,217 B1 8/2001 Lin
6,280,239 B1 * 8/2001 Cheng ..... 439/495
6,319,052 B1 * 11/2001 Chang ..... 439/495
6,558,186 B1 * 5/2003 LePottier et al. ..... 439/496

OTHER PUBLICATIONS

History of FFC/FPC http://www.avxcorp.com/does/Catalogs/ffchist.pdf.

* cited by examiner

*Primary Examiner*—Hien Vu
(74) *Attorney, Agent, or Firm*—Wei Te Chung

(57) ABSTRACT

An electrical connector assembly (1) includes a receptacle connector (10), a clamping device (20) and a flexible printed circuit (FPC) (30) having an edge (301) with conductive elements (300) thereon. The receptacle connector includes an insulative housing (100) defining a central slot (104) in a top surface (101) thereof and terminal passageways (1041) communicating with the central slot receiving respective conductive terminals (110). The clamping device includes two clamping panels (200) and two connecting sections (210) downwardly extending from two ends of the clamping panels. The clamping device defines a space (214) between the clamping panels for receiving the edge of the FPC. The edge of the FPC and the connecting section of the clamping device are inserted into the central slot of the housing and the conductive elements contacting respective terminals. The clamping panels clamp the FPC and the connecting sections thereof engaging with the housing.

2 Claims, 3 Drawing Sheets

ELECTRICAL CONNECTOR ASSEMBLY

BACKGROUND OF THE INVENTION

1. Field of the Invention

The present invention is related to an electrical connector assembly, and more particularly to a flexible printed circuit (FPC) electrical connector assembly.

2. Description of Related Art

Flexible printed circuit connectors are widely used in electronic devices such as mobile telephones, keyboards, hard disk drives and fax machines etc. The article named <History of FFC/FPC> recorded in http://www.avxcorp.com/docs/Catalogs/ffchist.pdf introduces the constitution of the flexible printed circuit, the terminal design of the flexible printed circuit electrical connector assembly and the development trend of several flexible printed circuit electrical connectors mounted onto printed circuit boards. However, the conventional flexible printed circuit electrical connector assemblies are complicated in structure and the connectors have a low locating precise to the flexible printed circuits.

For example, U.S. Pat. Nos. 5,580,272, 5,695,360 and 6,280,217 each disclose such an electrical connector. The connectors usually comprise an insulative housing and a cover pivoted in the insulative housing. When the cover is located in a first position, the end portion of the flexible printed circuit is inserted into a receiving space of the insulative housing, then rotating the cover to the second position and achieving an electrical connection between the flexible printed circuit and the electrical connector by pressing the cover. However, the electrical connectors are only used in the flexible printed circuits having conductive contact pads in one side, furthermore the whole connectors are complex in structure and have a low locating precise to the flexible printed circuits.

U.S. Pat. No. 5,947,764 discloses two connecting means used between a flexible printed circuit and a mother board. The first connecting means is an elastic member having two screw holes. When the elastic member is assembled onto the mother board, the contact pads of the end of the flexible printed circuit and the contact pads of the mother board are squeezed together by means of the elastic member and achieving an electrical connection between both. Although the connecting means is simple in structure, the connecting means is complicated to assemble and must resort to an auxiliary tool to locate the end portion of the flexible printed circuit. Additionally, the connecting means can't use in the occasion of limited assembly space. The second connecting means is an electrical connector assembly including a plug and a receptacle connector. The electrical connector assembly has disadvantages such as complexity in configuration, complication in assembly and high costs.

U.S. Pat. No. 5,967,831 discloses another connecting device between a flexible printed circuit and a mother board and having a receptacle connector and a guiding member. First, the flexible printed circuit is bent as a U shape and juxtaposed into a slot of the receptacle connector, then an insertion portion of the guiding member is inserted to a U-shaped recess formed in the flexible printed circuit and achieving an electrical connection between the flexible printed circuit and the receptacle connector by means of the squeezing of the insertion portion. Nevertheless, the flexible printed circuit itself has a certain flexibility so that it can't be well located when juxtaposed in the slot of the receptacle connector. Additionally, the insertion portion may be also affect the locating effect of the flexible printed circuit during the inserting process and thereby affecting the electrical transmission.

Hence, it is requisite to provide an electrical connector element which is simple in structure, convenient to assemble and can secure the exact connection between a flexible printed circuit and a receptacle connector.

SUMMARY OF THE INVENTION

Accordingly, an object of the present invention is to provide an electrical connector assembly which is simple in structure and convenient to assemble and directly achieving an reliable electrical connection between a flexible printed circuit and a receptacle connector.

In order to achieve the objective set forth, an electrical connector assembly in accordance with the present invention comprises a receptacle connector, a clamping device and a flexible printed circuit having a edge with a plurality of conductive elements thereon. The receptacle connector comprises an insulative housing defining a central slot in a top surface thereof and a plurality of terminal passageways receiving a corresponding plurality of conductive terminals. The clamping device comprises two clamping panels and two connecting sections downwardly extend from two ends of the clamping panels. The clamping device defines a space between the clamping panels and the edge of the flexible printed circuit being received in the space. The edge of the flexible printed circuit and the connecting section of the clamping device are inserted into the central slot of the insulative housing, and the conductive elements on the flexible printed circuit contacting the respective terminals. The clamping panels of the clamping device clamp the flexible printed circuit and the connecting sections thereof engaging with the housing.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
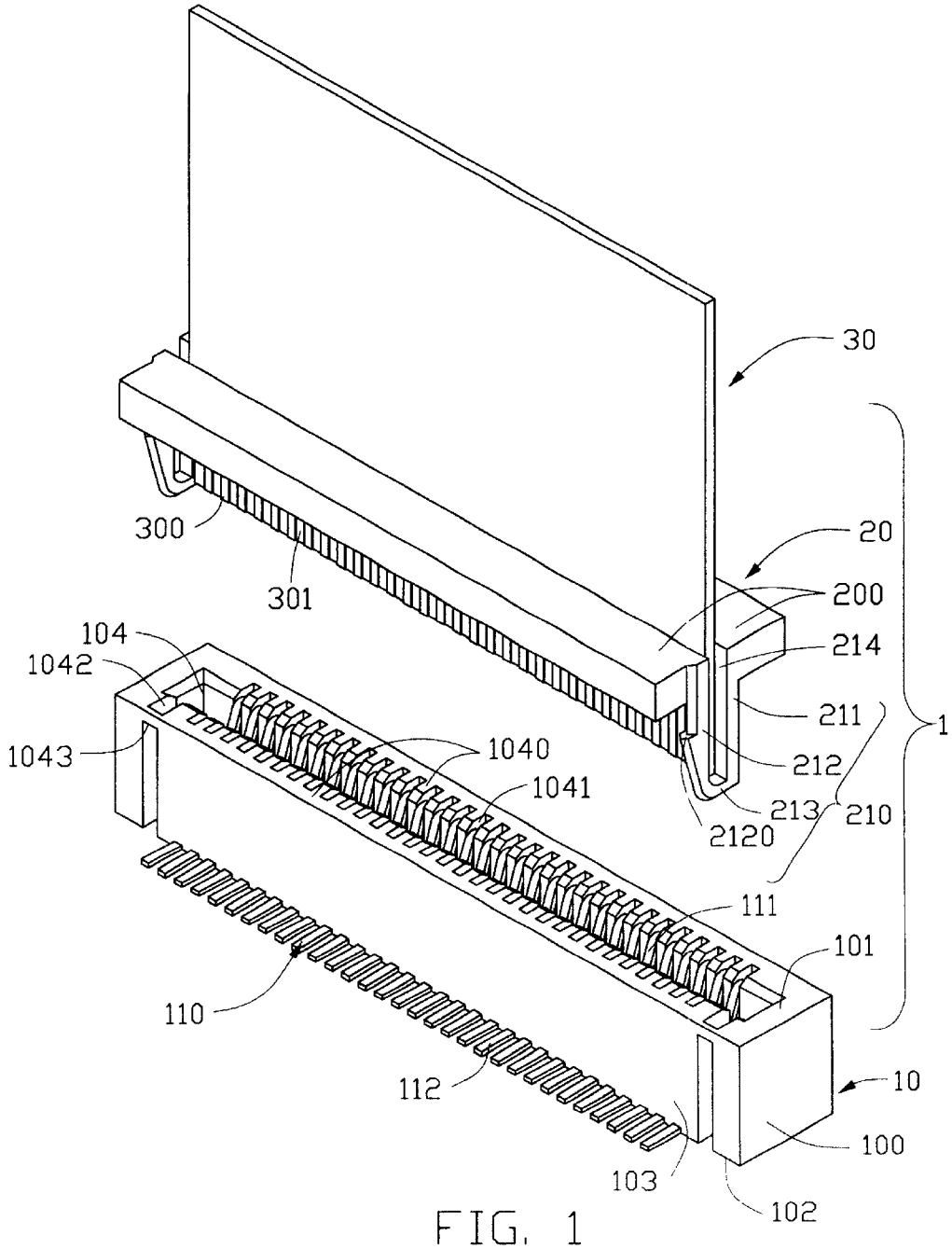
FIG. 1 is an exploded perspective view of an receptacle connector, a flexible printed circuit and a clamping device of an electrical connector assembly in accordance with the present invention.
Figure 2:
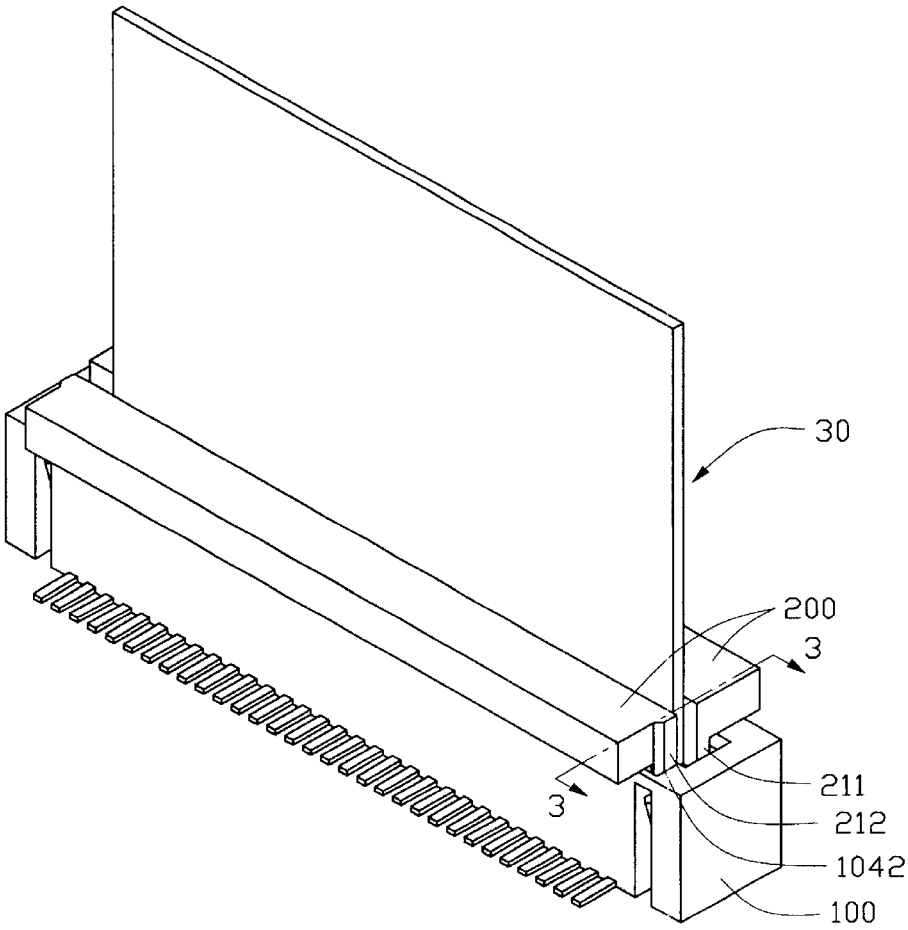
FIG. 2 is an assembled, perspective view of the electrical connector assembly of FIG. 1.
Figure 3:
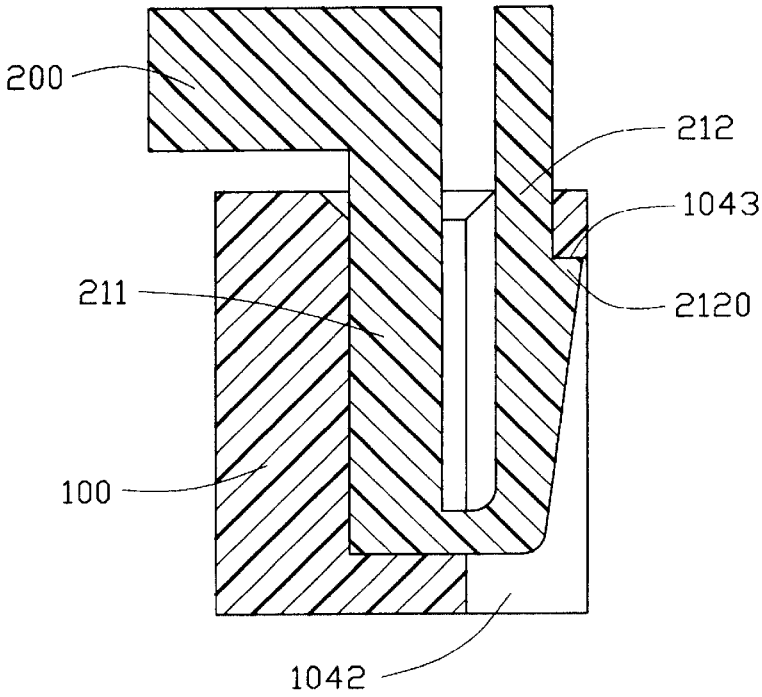
FIG. 3 is a cross-sectional view of the electrical connector assembly taken along line 3—3 of FIG. 2.

Referring to FIGS. 1 to 3, an electrical connector assembly 1 comprises a receptacle connector 10, a clamping device 20 and a flexible printed circuit (FPC) 30.

The receptacle connector 10 comprises an insulative housing 100 and a plurality of conductive terminals 110 retained to the housing 100. The insulative housing 100 extends longitudinally and has a top surface 101, a bottom surface 102 and two side surfaces 103. The top surface 101 of the insulative housing 100 defines a central slot 104. The housing 100 defines a plurality of terminal passageways 1041 in two side walls 1040 through the top surface 101 and the bottom surface 102 thereof and in communication with the central slot 104. The conductive terminals 110 are received in the respective terminal passageways 1041 and each includes a mating end 111 extending into the central slot 104 and a soldering end 112 extending beyond the bottom surface 102 of the insulative housing 100. The housing 100 further defines two recesses 1042 penetrating the top surface 101 and one of the side surfaces 103 thereof and in communication with the central slot 104. A shoulder 1043 is formed at the conjunction of the top and side surfaces 101, 103 of the housing 100 above each recess 1042.

The clamping device 20 comprises two clamping panels 200 extending longitudinally and two connecting sections 210 connecting end portions of said two clamping panels 200 and perpendicular to the extending direction of the clamping panel 200. A space 214 is defined between the two clamping panels 200 and is proximately the same as the thickness of the flexible printed circuit 30. Each connecting section 210 has a U shape and includes two vertical arms 211, 212 extending downwardly from the end portions of the clamping panels 200 and a curve section 213 connecting said two vertical arms 211, 212. The vertical arm 212 of each U-shaped connecting section 210 has a hook 2120 at an outer surface thereof for cooperating with the shoulder 1043 of the insulative housing 100. The two vertical arms 212 having the hooks 2120 are located in the same side of the clamping device 20.

In assembly, the clamping device 20 receives an edge 301 of the flexible printed circuit 30 in the space 214 thereof. The clamping device 20 and the edge 301 of the FPC 30 are inserted together into the central slot 104 of the insulative housing 100 so as to achieve an electrical connection between conductive elements 300 on the edge 301 of the FPC 30 and the conductive terminals 110 of the connector 10. At this time, the vertical arms 212 of the clamping device 20 are received in the recess 1042 of the insulative housing 100 and provide the function of guiding and locating during the insertion process of the FPC 30. When the clamping device 20 is completely inserted into the slot 104, the hooks 2120 of the vertical arms 212 engage the shoulders 1043 of the housing 100 so as to fix the clamping device 20 to the insulative housing 100. When unloaded, it is only required to squeeze the two clamping panels 200 of the clamping device 20 to cause the hooks 2120 to disengage from the shoulders 1043, then the clamping device 20 and the FPC 30 may be pulled out from the central slot 104 of the insulative housing 100. The configuration of the hooks 2120 and the recess 1042 provide the connector assembly 1 with blind-mating function.

The electrical connector assembly 1 in accordance with the present invention can secure an exact and stable electrical connection between the flexible printed circuit 30 and the receptacle connector 10 by the clamping device 20. Thus the whole electrical connector assembly 1 is simple in structure and convenient to assemble and further reducing the costs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a receptacle connector comprising an insulative housing, the insulative housing defining a central slot in a top surface thereof, and a plurality of terminal passageways communicating with the central slot, a plurality of conductive terminals being received in the respective terminal passageways;

a flexible printed circuit having an edge with a plurality of conductive elements thereon; and a clamping device comprising two longitudinal clamping panels extending perpendicularly to an insertion direction of the flexible printed circuit insertion being inserted into the central slot, and defining a space between the clamping panels, two connecting sections downwardly extending from two ends of the clamping panels, the edge of the flexible printed circuit being received in the space;

wherein the edge of the flexible printed circuit and the connecting sections are inserted into the central slot of the insulative housing, the conductive elements on the flexible printed circuit contacting respective terminals, the clamping panels of the clamping device clamp the flexible printed circuit and the connecting sections thereof engaging with the housing; wherein the terminal passageways are defined through the insulative housing; wherein each of the two ends of the insulative housing define a recess through the insulative housing and in communication with the central slot, a shoulder being formed in a side surface of the housing and extending from a bottom surface of the housing toward each recess; wherein each of the connecting sections of the clamping device has a U shape and comprises two vertical arms and a curve section connecting the two vertical arms; wherein one of the vertical arms of each connecting section has a hook cooperating with the shoulder of the recess of the insulative housing and the two arms having the hooks are located in the same side of the clamping device for receiving in the shoulders in the same side of the side surface.

2. The electrical connector assembly as claimed in claim 1, wherein the conductive terminal comprises a mating end extending into the central slot and a soldering end extending beyond the bottom surface of the insulative housing.

* * * * *